US005421783A

United States Patent [19]

Kockelman et al.

[11] Patent Number: 5,421,783

[45] Date of Patent: Jun. 6, 1995

[54] HUMAN SLINGSHOT MACHINE

[75] Inventors: Peter T. Kockelman, Palo Alto; John W. Kockelman, Mountain View, both of Calif.

[73] Assignee: Bungee Adventures, Mountain View, Calif.

[21] Appl. No.: 92,701

[22] Filed: Jul. 16, 1993

[51] Int. Cl.[6] ..... A63G 31/14

[52] U.S. Cl. ..... 472/135; 472/50; 472/131; 482/43

[58] Field of Search ..... 472/135, 50, 131, 137; 482/33, 23, 24, 43, 66

[56] References Cited

U.S. PATENT DOCUMENTS

| | | | |
|---|---|---|---|
| 562,448 | 6/1896 | Zedora | 482/26 |
| 3,826,492 | 7/1974 | Hagan | 472/118 |
| 4,431,182 | 2/1984 | Reynolds | 482/27 |
| 4,449,716 | 5/1984 | Goldy et al. | 482/43 |
| 5,064,191 | 11/1991 | Johnson | 472/135 |
| 5,087,037 | 2/1992 | Morrow | 482/33 |
| 5,094,448 | 3/1992 | Hackett | 472/135 |
| 5,203,744 | 4/1993 | Checketts | 472/131 |
| 5,221,241 | 6/1993 | Bare, II | 472/23 |
| 5,267,906 | 12/1993 | Kitchen et al. | 472/131 |

*Primary Examiner*—Carl D. Friedman
*Assistant Examiner*—Kien Nguyen
*Attorney, Agent, or Firm*—Flehr, Hohbach, Test, Albritton & Herbert

[57] ABSTRACT

An amusement ride for slingshotting and bouncing humans with bungee cords. The ride is similar to a bungee jump, except that two separate bungee cords are used, and the jumper (rider) starts on the ground. The ride keeps most of the thrilling sensations of bungee jumping, but reduces or eliminates many of the dangers, including hitting the ground, swinging into a tower, and getting tangled in the cords. The slingshot ride consists of two elevated supports (10). In between the two elevated supports is a carrier (24). Two spring members (12) connect the carrier to the top of both supports (picture the letter "M"). A rider is strapped into the carrier that is secured to the ground with a release mechanism (28). The two springs are stretched with a tensioning mechanism (22). The release mechanism is triggered by the operator, and the rider is shot up into the air. The strapped-in rider bounces up and down about four times before being lowered to the ground.

10 Claims, 3 Drawing Sheets

HUMAN SLINGSHOT MACHINE

BACKGROUND—FIELD OF INVENTION

This invention relates to an amusement/gymnastic device for projecting and bouncing humans.

BACKGROUND—DESCRIPTION OF PRIOR ART

This invention has its roots in bungee jumping. Bungee jumping is the sport of jumping from a tall structure while connected to a big rubber band (bungee cord). In the United States, bungee jumping is most frequently done from a crane over the ground. Bungee jumping has three possible problems: the jumper could hit the ground, swing into a support tower, or get tangled in the cord.

When a jumper hits the ground, it is usually for one of two reasons. First, the cord stretches too far, because the jumper is too heavy for the cords or the adjustable cord length was lengthened too much. Second, the jumper was not attached to all the cords, or all the cords were not attached to the structure. Both these reasons for hitting the ground are usually attributed to operator error. A bungee jumping operator is always connecting and reconnecting different size bungee cords for different weight jumpers. The probability of an error increases as the operator's duties and decisions increase.

The jumper can sometimes swing or bounce into the support tower due to improper exit velocity. With a crane, the support tower is normally the boom or mast of the crane and the exit platform is the crane basket. If the crane basket is close enough to the tower and if the jumper pushes off hard enough in the wrong direction (toward or 180 degrees away from the tower), the jumper could swing or bounce into the tower. Even if the crane is set up so this cannot happen, the operator can carelessly reposition the crane elements so this dangerous condition exists.

The third possible problem with bungee jumping is getting tangled in the cords. Because the jumper is jumping off a single elevated support (the crane basket) with one bungee cord (or multiple cords banded together as one cord) the jumper will always rebound toward the single support point. The jumper has the highest probability of getting tangled in the cord at the top of the first rebound when the cord goes slack. This can be particularly dangerous if the cord wraps around the jumper's neck.

Besides having these three problems, bungee jumping has a limited appeal because of the fear involved in climbing and jumping from a tall structure. To lessen this fear, a modified version of the sport evolved, called reverse bungee jumping, which takes place mainly from cranes. In reverse bungee jumping a person is held on the ground while an attached bungee cord is tensioned by hoisting the crane basket. When adequate tension is built up in the bungee cord, the jumper's friends release him and the jumper is propelled upward toward the crane basket.

Reverse bungee jumping solves most of the problems that might cause the jumper (rider) to hit the ground because he/she starts on the ground and gets farther away with each additional bounce, even if the operator uses the wrong length and thickness of bungee cord. Reverse bungee jumping adds some additional problems, however. If the crane basket is hoisted too high, the jumper can be projected up so violently that he/she strikes the anchor point (the steel crane basket). If the jumper goes high enough to strike the crane basket, the cord tangling problem is now worse because of the additional cord slack.

In the amusement ride industry, the ability to rotate or flip a rider is often a desirable ride characteristic. Both types of bungee jumping fail to provide a reliable and safe way to flip the jumper. If the jumper is flipping when the cord becomes taut, the jumper's head will usually hit the now tight (and hard) cord. The probability of a cord tangle injury increases if the jumper is flipping when the cord goes slack.

The bungee jumping system described in U.S. Pat. No. 5,094,448 to Hackett (1992) is geared toward jumping off bridges, over water. This system involves a mechanism to adjust how close the jumper comes to the ground/water, which increases the potential for operator error by putting too much decision-making and control into their hands. The operator can adjust how close the jumper gets to the ground/water without providing a control method to make sure the jumper does not hit the ground or strike the water too hard. This system works with the conventional bungee system of one cord and one support with the jumper jumping from the top. This patent does little to solve the three problems of bungee jumping discussed above.

Moving away from bungee jumping, we find an old patent very similar to the human cannon normally used in circuses but with an unusual twist. The human cross-bow described in U.S. Pat. No. 562,448 to Zedora (1896) projects a specially skilled performer (acrobat) into the air using a combination of rubber cords and the bow pan of a bow-and-arrow. Like the human cannon, the human cross-bow uses a device (barrel or board) to guide the performer's trajectory. Once projected into the air, the performer is no longer attached to the projecting device and must have some other means to safely cushion or catch their body. The performer must be highly skilled and properly positioned so as not to get injured by the separate landing pad or net. Because the projecting force is applied through the performer's feet, the performer must be properly aligned or back injury could result. Because the performer's trajectory is guided by a stationary board, the performer must be careful not to drag a hand or foot near the stationary elements (board and bow) or an injury could result. It is clear from the above that this is a device for a highly skilled performer and would not be used as an amusement ride for the general public.

The "Human Free-Flight Amusement Devices" U.S. Pat. No. 4,431,182 to Reynolds (1984) describes a wide variety of accelerating and decelerating devices to be used for throwing and catching people. The specifically claimed catching device is a modified air bag. Separate throwing and catching devices increase the danger and probability of injury. This increase in danger mainly occurs during the transition from throwing to catching, which often requires a specific skill, reaction, non-reaction, or body position from the occupant who is often a skilled performer (acrobat). No bouncing devices are cited, and all the throwing (projecting) devices have a separate means for catching the thrown person.

A non-projecting device for children, the "Spring Swing" described in U.S. Pat. No. 3,826,492 to Hagen (1974) is made of elastic tubing and is primarily used for swinging, but a mild bouncing motion can be initiated by the child's feet. There are no mechanical means to store energy in the rubber to rapidly accelerate or project the child upwards. This elastic swing calls for a single "overhead support,") and the two examples used are an overhead beam and a tree limb. If there were a mechanical means (i.e., winch) to pull the child down, and the child was pulled down too far, the child could potentially hit the overhead support. Because the child's swing is a simple toy and the child always remains close to the ground, there is no need to lower the child to the ground after they are done swinging.

The following scenario is possible, but unlikely: Since the child has control of the swinging and bouncing amplitude, it is possible he/she could put enough energy into the system to strike the ground. This would happen if the child pumped the swing high enough to cause the rubber to over-stretch at the critical point (bottom of swing pendulum). Since the child would be at maximum speed at the critical point, he/she could be injured.

OBJECTS AND ADVANTAGES

The main objective of The Human Slingshot Machine is to reduce the risks and fears of bungee jumping while keeping most of the thrilling sensations. The slingshot ride (slingshotting) will still provide the thrilling sensations of free-fall, weightlessness, rebounding, and bouncing. Slingshotting is less frightening than bungee jumping because the jumper (rider) starts on the ground instead of high off the ground, and the operator activates a release rather than relying on the jumper's nerve to jump.

Slingshotting is reverse bungee jumping with two cords. Like reverse bungee jumping, slingshotting avoids the problem of hitting the ground because the rider starts on the ground and all successive bounces get farther away from the ground.

In slingshotting, operator error is reduced through the use of one size cord for all weights of riders, since initial (maximum stretch) cord tension is determined by variables other than the rider's weight. The operator uses the same size bungee cord for all riders and only changes the cords (connects and reconnects) when the cords wear out or other maintenance is needed.

The swinging into the structure problem is avoided because the rider's exit (start) direction and speed are predetermined by set variables and not by the whim of the rider. The well defined trajectory path is due to a repeatable start condition and the use of two cords instead of one. Two cords limit the rider's trajectory more than one cord does.

Slingshotting has a significant advantage over both standard bungee jumping and reverse bungee jumping in that the rider cannot get tangled in the cords. This advantage also derives from the dual elevated support design where the rider is projected up the middle of the elevated supports, thus placing the cords off to the side of the rider and not directly above him. Remember that in both types of bungee jumping the jumper rebounds directly toward the anchor and into the slack bungee cord. If the unstretched lengths of the bungee cords are less than one-half the distance between the two elevated supports, then the bungee cords will never go slack. Slingshotting eliminates bungee jumping (both types) cord tangle.

Another advantage of slingshotting over reverse bungee jumping is that there is no overhead support to hit. The dual elevated support design provides two anchor points for the bungee cords rather than one. The rider is projected up the middle of the two elevated supports rather than straight at a single elevated support. Even if the cords are over-tensioned, caused by over-hoisting, there is nothing in the rider's trajectory path to hit.

The two bungee-cord slingshotting system provides an ideal geometry to flip the rider. Because the cords are always off to the side, the rider is free to flip, in the pitch axis, at any time, including when the bungee cord tension is high. The seat can be automatically flipped by the projecting force, depending on where the bungee cords and release attach to the seat in relation to the rider's center-of-gravity. The seat will also reliably flip over at the top of the towers when the bungee cord force changes direction. If the connections from the bungee cords to the seat are of a swivel variety, the seat is free to flip with no twisting of the cords. This flipping adds an element of thrill that bungee jumping (in its current form) cannot reliably provide.

Another advantage of The Human Slingshot Machine is that the operator and spectators are always on the ground. The operator is not exposed to the danger of falling, because all ride operation and maintenance is done at ground level. In bungee jumping, the operator and spectators are in the crane basket that is directly above the jumper. Any time people are directly above other people, there is a risk of the people above dropping something (tool, camera, or soda bottle) on the people below.

Slingshotting has some significant advantages over the human cannon type patents mentioned in the Prior Art section above. These human cannon patents have separate acceleration (throwing) and deceleration (catching) devices. In slingshotting the throwing and catching device are the same. Both the acceleration and deceleration forces are produced by the elastic properties of the bungee cords. The slingshot rider remains strapped to the seat for the duration of the ride. Having the same throwing and catching device decreases the probability of injury.

In human-cannon type devices the projecting force is often applied at the feet. If the rider is not precisely aligned, they could be injured. In slingshotting the force is applied through a seat to the rider's center-of-gravity, which requires much less body alignment technique. In slingshotting, there is no guiding device like the barrel of the cannon. This eliminates the possibility of the rider's rapidly accelerating body striking a stationary object such as the guiding device.

The support height of the slingshot ride is roughly ten (or more) times the support height of the child's spring swing. Because of this, it would be almost impossible for the slingshot rider's motion during bouncing to cause the bounce amplitude to increase to a point that would cause the rider to strike the ground. Also, the slingshot rider could not impact an overhead support in the event of bungee cord over-tensioning as there is no overhead support.

Further objects and advantages of this invention will become apparent from a consideration of the drawings and ensuing description.

DRAWING FIGURES

REFERENCE NUMERALS IN DRAWINGS

Figure 1:
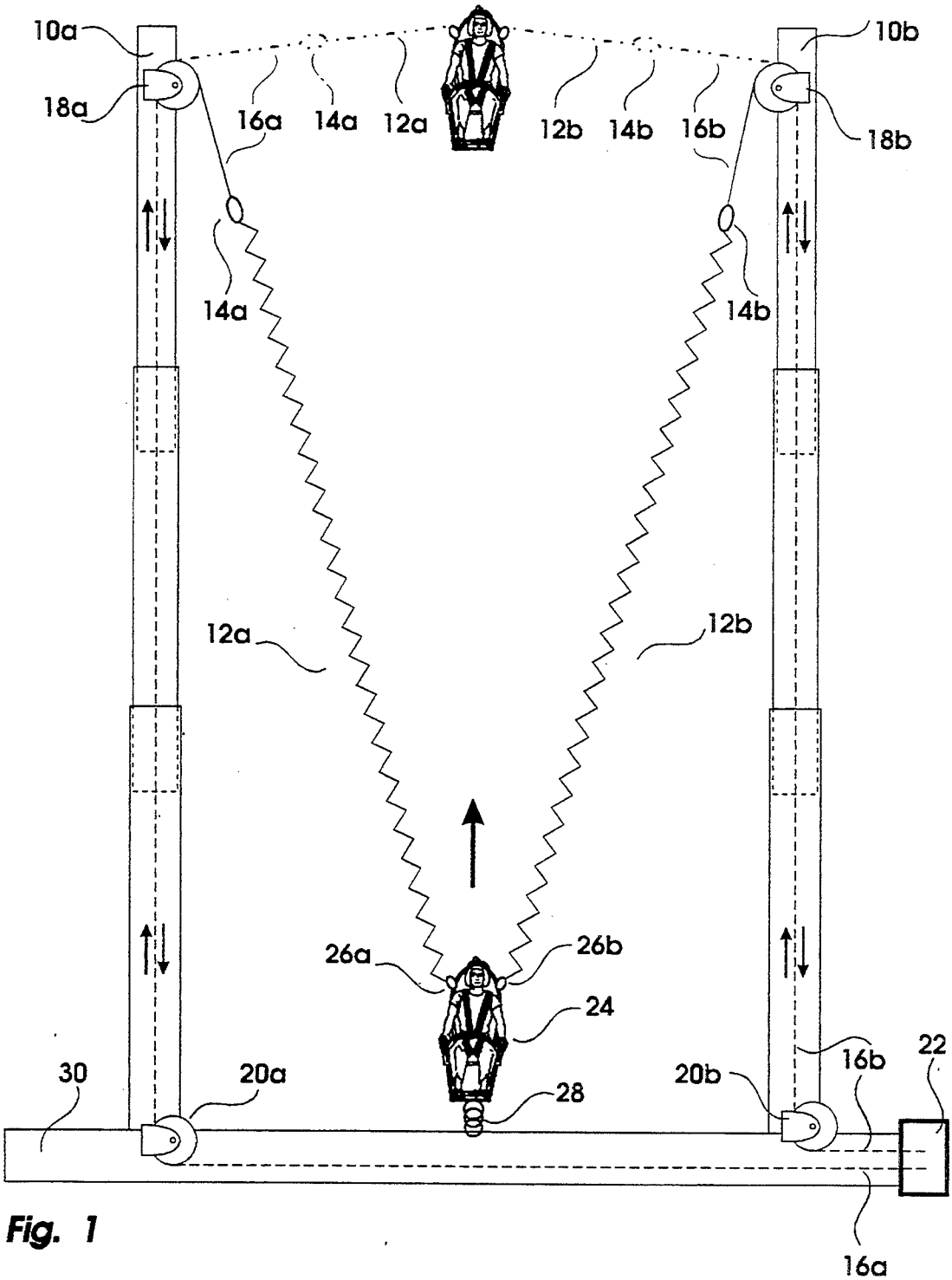
FIG. 1 shows a front view of the two-cable winch design using vertical towers as elevated supports.
Figure 2:
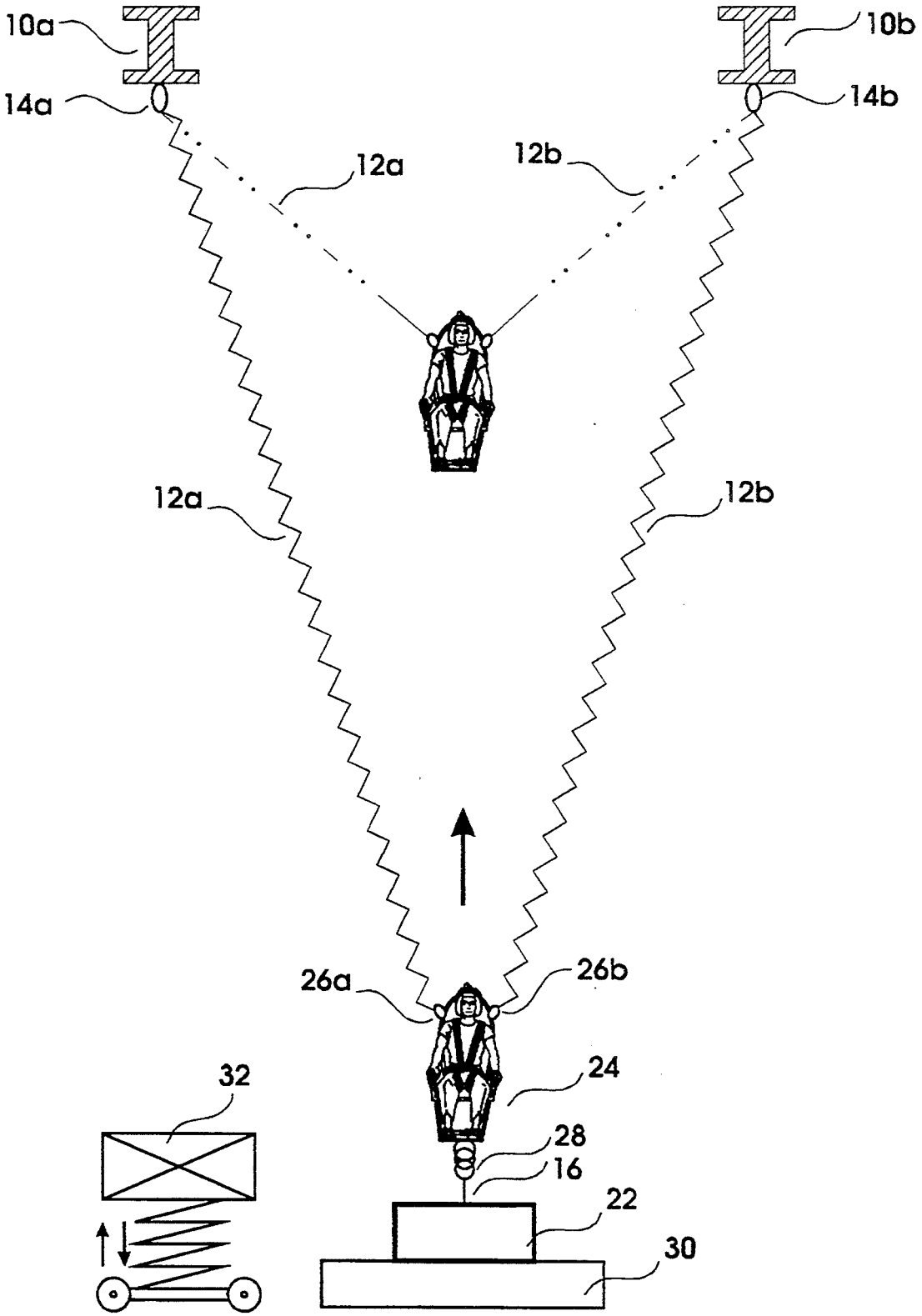
FIG. 2 shows a front view of the one-cable winch design using horizontal beams as elevated supports.

10 elevated supports
12 spring members
14 links
16 cables
18 top cable support members (FIG. 1 only)
20 bottom cable support members (FIG. 1 only)
22 tensioning mechanism
24 carrier
26 links
28 release mechanism
30 base
32 elevating mechanism (FIG. 2 only)

SUMMARY OF THE INVENTION

The Human Slingshot Machine is similar to a normal slingshot, except that instead of projecting a rock horizontally, a human is projected vertically, and instead of projecting a rock into space, the human stays attached to the rubber cords and bounces up and down. It is similar to a reverse bungee jump where the rider starts on the ground, except that two separate cords are used, rather than one. The two cords go up and to the sides in a "V" shape. The following two paragraphs describe the form and operation of the present invention (both refer to FIG. 1 and FIG. 2).

The slingshot ride consists of two elevated supports roughly 40 meters (120 feet) high and 20 meters (60 feet) apart. On the ground, in between the supports is a human (rider) strapped into a seat, which is secured to the ground by a release mechanism. Two bungee cords connect the seat to the elevated supports (visualize the letter "V"). The bungee cords are tensioned by using a ground-based winch.

When the release is triggered, the rider, strapped into the seat, is shot up into the air. After reaching the apex, above the supports, the rider falls back toward the ground, while the bungee cords cushion the fall. The cords bounce the rider up and down four or five times before the rider comes to rest, roughly 10 meters (30 feet) above the ground. The rider is slowly lowered to the ground with a winch controlled by an operator. To make this patent easier to read, the rider is referred to in the singular sense. However, the ride is designed to hold one or more riders.

The primary difference between FIG. 1 and FIG. 2 is in how the bungee cords are tensioned. There are two different designs of the slingshot ride. The two-cable winch design (FIG. 1) tensions the bungee cords from the top by two winch-cables (while the seat remains attached to the ground). The one-cable winch design (FIG. 2) tensions the bungee cords from the bottom (through the seat) with one winch-cable, while the tops of the bungee cords always remain fixed to the elevated supports. In the two-cable winch design, the four pulleys route the cables from the ground-based winch to the tops of the bungee cords.

A secondary difference between the two figures is the specific type and implementation of elevated supports used. The vertical tower type is illustrated in FIG. 1, while the horizontal beam type is illustrated in FIG. 2. It is very important to understand that either elevated support type (or a combination of the two) could be used in either design (two-cable winch or one-cable winch). The design (two-cable winch or one-cable winch) is independent of the elevated support type (vertical tower or horizontal beam).

DESCRIPTION—FIG. 1

The two-cable winch design of the present invention is illustrated in FIG. 1. All physical parts described in this section relate to FIG. 1, unless otherwise noted. All references to "preferred embodiment" refer to the current version of a working prototype (similar to FIG. 1) that was built and tested by the inventors. A pair of elevated supports 10*a* and 10*b* are rigid structures functioning as fixed supports for a pair of top cable support members 18*a* and 18*b*. Elevated supports 10*a* and 10*b* are required to support the static and dynamic loads placed on them from a pair of tensioned spring members 12*a* and 12*b*. Elevated supports 10*a* and 10*b* should be separated by a distance greater than the width of a carrier 24 so as not to interfere with the trajectory of the rider, which is primarily a vertical path between elevated supports 10*a* and 10*b*. A horizontal connection between the upper parts of elevated supports 10*a* and 10*b* would not be desirable. There are a wide variety of elevated support types that can be successfully constructed. One type is the vertical-towers (shown in FIG. 1) and the other is a horizontal-beams (shown in FIG. 2). It is important, however, to understand that the two-cable winch design could use a variety of implementation of elevated supports including either the vertical tower or the horizontal beam (or a combination of the two).

In the vertical-tower type (FIG. 1), elevated supports 10*a* and 10*b* could be columns, pillars or towers, constructed from multiple sections of poles, tubes, or trusses. The sections could be telescoped together for easy setup, breakdown, shipping, and storage. The vertical towers could be free-standing or guyed-down.

In the horizontal-beam type (FIG. 2), elevated supports 10*a* and 10*b* could be horizontal beams in the ceiling or roof of any building or structure. Elevated supports 10*a* and 10*b* (in both the horizontal and vertical types) could be made from a variety of materials including metal, concrete, wood, and plastic. Vertical towers are used in the preferred embodiment. These towers are made from telescoping members of tubular steel and are guyed-down with steel cables.

A foundation or base 30 acts as a foundation and provides the support and connection point necessary to hold carrier 24 on the ground while spring members 12*a* and 12*b* are being tensioned by a tensioning mechanism 22. Base 30 would be located directly below and in between elevated supports 10*a* and 10*b*. Base 30 could function as a support structure for elevated supports 10*a* and 10*b* in the vertical-tower implementation mentioned above. Base 30 could also function as the support structure for a pair of bottom cable support members 20*a* and 20*b*. A wide variety of different types of designs would work here. Base 30 could be as simple as a concrete slab or platform with a loop of metal rod coming out of the top for an attachment point for a release mechanism 28. Base 30 is non-essential and could be eliminated if tensioning mechanism 22 is anchored to the ground or tensioning mechanism 22 is heavy enough to not require anchoring. In the preferred embodiment, a horizontal steel "I" beam connects the bottoms of the vertical-towers. Base 30 supports and connects to release mechanism 28.

Release mechanism 28 provides means to securely hold and then quickly disconnect carrier 24 from base 30 while spring members 12*a* and 12*b* are under tension. This device is also referred to as a quick-release.

Release mechanism 28 could be a "three-ring release"that is commonly used in the parachute industry or a snap-shackle that is commonly used in the marine industry. In the preferred embodiment, release mechanism 28 is an electromagnet with a hold/release (on/off) switch. Release mechanism 28 connects carrier 24 to either base 30 or the ground.

Carrier 24 safely supports and securely holds one or more riders. Carrier 24 safely supports the riders in a way to prevent injury and maximize comfort. Normally carrier 24 would securely hold the rider so he/she would remain attached to carrier 24 during the duration of the ride and not accidentally fall out. In certain stunt situations the rider would not be required to be secured to carrier 24. Carrier 24 could be as simple as a harness used to support a rock-climber. In the preferred embodiment, carrier 24 is similar to a dual roller coaster seat where each rider is strapped in with dual shoulder belts and a standard lap belt.

A pair of links 26*a* and 26*b* connect carrier 24 to spring members 12*a* and 12*b*. Links 26*a* and 26*b* are standard connections or couplings to make it easy to replace spring members 12*a* and 12*b* if needed. Links 26*a* and 26*b* could be shackles, carabiners, or swivel connectors.

Elongated spring members 12*a* and 12*b* provide the projecting (accelerating) force as well as the cushioning (decelerating) force for the rider. Spring members 12*a* and 12*b* can be of a wide variety of types and materials. Spring members 12*a* and 12*b* could be constructed of metal, rubber, or any of the wide variety of bungee cord designs available in the bungee jumping industry. In the preferred embodiment, spring members 12*a* and 12*b* are bungee cords made from natural rubber and backed up for safety with nylon webbing that runs parallel to the rubber from end to end; the rubber and webbing are encased in a sheath made from an elastic fabric. The function of the nylon webbing is to prevent the rider from hitting the ground in case of rubber failure or excessive rubber elongation.

A pair of links 14*a* and 14*b* connect spring members 12*a* and 12*b* to a pair of cables 16*a* and 16*b*. Links 14*a* and 14*b* are standard connections or couplings to make it easy to replace spring members 12*a* and 12*b* if needed. Links 14*a* and 14*b* could be shackles, carabiners, or swivel connectors.

Cables 16*a* and 16*b* transmit the mechanical force from tensioning mechanism 22 to spring members 12*a* and 12*b*. Cables 16*a* and 16*b* can be made from a variety of inelastic-cord materials including nylon rope. In the preferred embodiment, cables 16*a* and 16*b* are made from wire-rope.

Top cable support members, sheaves or pulleys 18*a* and 18*b* are mounted to elevated supports 10*a* and 10*b*. Top cable support members 18*a* and 18*b* are designed for low friction support and routing of cables 16*a* and 16*b*. Top cable support members 18*a* and 18*b* could be designed with a cable guard so that cables 16*a* and 16*b* cannot slip off the cable support members.

Bottom cable support members, sheaves or pulleys 20*a* and 20*b* are mounted near the ground and below top cable support members 18*a* and 18*b*. Bottom cable support members 20*a* and 20*b* could be directly connected near the bottom of tower type elevated supports 10*a* and 10*b* or to base 30, and am designed for low friction support of cables 16*a* and 16*b* as they are both muted to tensioning mechanism 22. Bottom cable support members 20*a* and 20*b* could be designed with a cable guard so that cables 16*a* and 16*b* cannot slip off the cable support members.

The main function of all four cable support members is to route cables 16*a* and 16*b* from the top of spring members 12*a* and 12*b* to ground-based tensioning mechanism 22 without interfering with the rider's trajectory. In the preferred embodiment, top cable support members 18*a* and 18*b* and bottom cable support members 20*a* and 20*b* are all pulleys.

Tensioning mechanism 22 provides the mechanical force necessary to put spring members 12*a* and 12*b* in tension and a braking feature (not specifically shown in the figures) to hold spring members 12*a* and 12*b* in tension. In a broader sense, tensioning mechanism 22 could provide the force transmission function of cables and the cable routing function of pulleys. Tensioning mechanism 22 is mounted to and supported by either base 30 or the ground. Tensioning mechanism 22 can be a winch, hoist, or block and tackle system with an ascender brake. An ascender is a rock-climbing ratchet device that will permit a rope to slide through in one direction but not the other direction, so it acts like an on/off brake. Tensioning mechanism 22 could also include cables and cable support members. Tensioning mechanism 22 can be powered by one of a variety of sources (not specifically shown in the figures) such as human, gas, electric, hydraulic, or pneumatic, etc. In the preferred embodiment, tensioning mechanism 22 is an electric-powered winch.

OPERATION—FIG. 1

The operation of the Human Slingshot Machine (two-cable winch design of FIG. 1) is divided into four phases: setup, tension, release, and lowering. In the setup phase, a ride operator attaches carrier 24 to either base 30 or the ground by engaging release mechanism 28. The rider then sits in carrier 24 and the ride operator fastens the safety straps that secure the rider to carrier 24.

In the tension phase, the ride operator tensions spring members 12*a* and 12*b* with tensioning mechanism 22. The tension is adjusted according to the weight of the rider and the acceleration (G force) desired. Heavier riders require more tension than light riders for the same acceleration. When the desired tension is obtained, the brake of tensioning mechanism 22 is set.

In the release phase, the ride operator activates or triggers release mechanism 28, and the action or oscillatory motion part of the ride begins. The rider is projected vertically upwards in a linear trajectory midway between elevated supports 10*a* and 10*b*. In the preferred embodiment, the tension in spring members 12*a* and 12*b* is enough to project the rider above the top of elevated supports 10*a* and 10*b*. When carrier 24 is in line with top cable support members 18*a* and 18*b* there is no slack in spring members 12*a* and 12*b*. Above the tops of elevated supports 10*a* and 10*b* the spring forces reverse direction and starts to force carrier 24, and the rider secured to it, back down. The rider bounces up and down about four or five times until the bounces are damped to a steady state condition and the rider comes to a stationary rest, suspended above the ground. This suspended point of carrier 24 is known as the equilibrium position.

In the lowering phase, the brake of tensioning mechanism 22 is slowly released in a controlled manner and gravity lowers carrier 24 and rider to the ground. Once safely on the ground the ride operator unstraps the rider from carrier 24, and the operation cycle is ready to be repeated.

DESCRIPTION—FIG. 2

The one-cable winch design of the present invention is illustrated in FIG. 2. The FIG. 2 drawing specifically depicts elevated supports 10*a* and 10*b* as cross-sections of horizontal "I" beams. It is important, however, to understand that the one-cable winch design could use a variety of elevated support implementations (including the vertical tower and horizontal beam). The Summary of the Invention section explains the differences between the one-cable winch (FIG. 2) and the two-cable winch (FIG. 1) designs. The description of FIG. 2 is the same as the description for FIG. 1 except as explained below.

Elevated supports 10*a* and 10*b* (the horizontal-beam implementation is shown) are connected to spring members 12*a* and 12*b* with links 14*a* and 14*b*. Top cable support members 18*a* and 18*b* and bottom cable support members 20*a* and 20*b* are eliminated. Cables 16*a* and 16*b* (dual winch-cables) are replaced by a cable 16 (single winch-cable). Base 30 can be eliminated if tensioning mechanism 22 has enough weight to counteract the maximum tension force in spring members 12*a* and 12*b*. Cable 16 could be considered a component of, and is attached to, tensioning mechanism 22. The other end of cable 16 is attached to release mechanism 28. Release mechanism 28 provides means to securely hold and quickly disconnect carrier 24 from cable 16 while spring members 12*a* and 12*b* are under tension. In an alternative configuration, not shown in the drawings, release mechanism 28 could connect carrier 24 directly to base 30.

An elevating mechanism 32 provides a way to raise release mechanism 28 (with or without an operator) so that release mechanism 28 can be reconnected to carrier 24 when carrier 24 is suspended above ground in the equilibrium position. Elevating mechanism 32 could be as simple as a pole for extending the reach of the operator or a removable ladder that the operator climbs. Elevating mechanism 32 can be as complex as an externally powered man-lift (specifically shown in FIG. 2). Elevating mechanism 32 should be mobile and is not required to be attached or connected to any other structural element.

OPERATION—FIG. 2

The operation of the slingshot ride (one-cable winch design) is similar to the operation of the two-cable winch design of FIG. 1, except as stated below. The operation is divided into four phases: setup, tension, reload, and release.

In the setup phase, the ride operator (or rider) attaches cable 16 to carrier 24 by engaging release mechanism 28. Since the rider is attached to carrier 24 and suspended above the ground, the ground-based operator would first elevate release mechanism 28 using elevating mechanism 32. Elevating mechanism 32 could elevate release mechanism 28 by itself or with a human operator. If release mechanism 28 were elevated by itself, then the rider would engage release mechanism 28. If the operator and release mechanism 28 were elevated together, the operator would engage release mechanism 28. Elevating mechanism 32 could be eliminated if the ground-based operator threw cable 16 and release mechanism 28 up to carrier 24 so the rider could engage release mechanism 28. Tossing these two elements would be a crude, but possible, alternative method of operation.

In the tension phase, the ride operator tensions spring members 12*a* and 12*b* with tensioning mechanism 22. Spring members 12*a* and 12*b* are tensioned while carrier 24 is lowered to the ground. When carrier 24 is on or near base 30 the brake of tensioning mechanism 22 is set. In the reload phase, the old rider is unstrapped and removed from carrier 24 and the new rider is strapped into carrier 24.

In the release phase, the ride operator activates or triggers release mechanism 28 and the action or oscillatory motion part of the ride begins. The rider is projected vertically upwards in a linear trajectory midway between elevated supports 10*a* and 10*b*. After the release phase the operation cycle is ready to be repeated.

SUMMARY, RAMIFICATION, AND SCOPE

In summary, many of the advantages of the slingshot ride over bungee jumping stem from the fact that slingshotting involves two separate cords (anchored to two separate supports) where bungee jumping only involves one cord (anchored to one support). Slingshotting involves rebounding in between the anchors and cords, and not into them. To make it even safer, the cord length can be chosen so that the cords never go slack. The probability of hitting the ground or a side tower is significantly reduced because the rider starts on the ground and is projected straight up in a consistent and repeatable manner.

The two-cable winch design (FIG. 1) has the advantage of being easier, faster, and safer to operate than the one-cable winch design (FIG. 2) but is a little more complex and expensive to build. The advantages of the two-cable winch design would be valuable in a high-volume amusement ride application. The four cable support members in the two-cable winch design (FIG. 1 ) make this design unique and safer because the top of both bungee cords can be inspected and replaced from the ground.

While the above descriptions of FIG. 1 and FIG. 2 contain many specificities, these should not be construed as limitations on the scope of the invention, but rather as an exemplification of one preferred embodiment thereof. Numerous other variations are possible.

For example, one ramification could be its use as a stunt device, more in line with a real slingshot, where the rider (stunt person) is not strapped into the carrier and becomes separated from the carrier at the top of the elevated supports. If the stunt person is projected with enough force, he/she could be projected high enough to allow a parachute-like device to open safely. The stunt person can then descend to the ground under the parachute-like device.

Another ramification could be its use as a gymnastic training device where gymnasts and/or divers could safely learn new flipping and twisting maneuvers. The carrier could be a conventional "twisting belt", a safety and training aid worn by a trampolinist, and the links could be swivel connectors. For a variation on this theme, the carrier could be designed to be gyroscopic-like, and gimbaled on one, two, or three axes.

Figure 3:
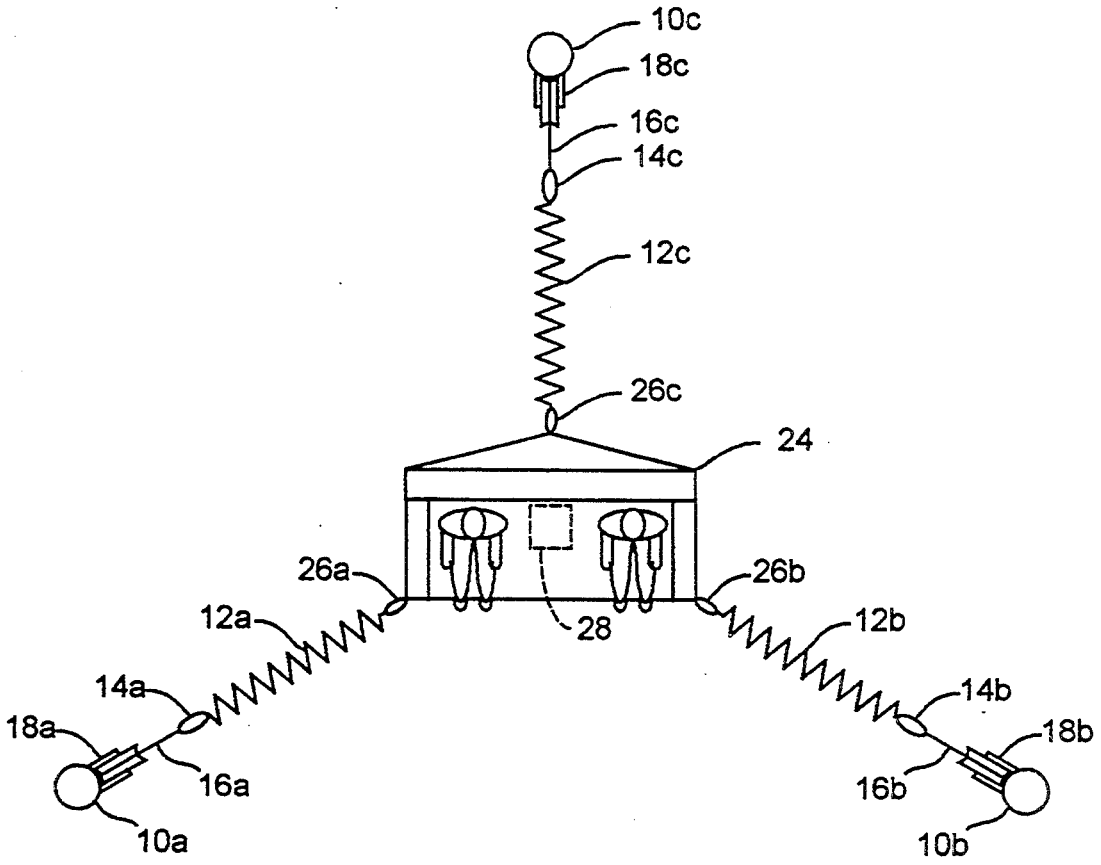
FIG. 3 shows a top plan view of an alternative embodiment of the slingshot machine of the present invention employing three elevated supports and corresponding spring members coupled to the carrier.

If more control over the rider's trajectory is required, one or more springs and supports could be added, as shown in FIG. 3. This would be desirable in a windy environment. Since two springs primarily control the rider's trajectory in two dimensions, a third spring would control the rider's trajectory in three dimensions.

To simplify the number of elements in the invention, all four cable support members and the ground-based winch could be replaced with two winches. Each winch would be mounted to its own elevated support. To simplify things further, the two springs could be eliminated by using high-speed, high-power, computer-controlled winches to simulate the projecting and bouncing motion of the springs.

To make this patent easier to read, the :rider is always referred to in the singular sense. However, the ride is designed to hold one or more riders. Accordingly, the scope of the invention should be determined not by the embodiments illustrated, but by the appended claims and their legal equivalents.

What is claimed is:

1. An amusement ride apparatus comprising:

a carrier formed and dimensioned to safely support at least one human therein;

a first elevated support and a second elevated support spaced apart by a distance sufficient to permit unobstructed passage of said carrier therebetween;

a first elongated spring member having one end coupled to said carrier and having an opposite end supported by said first elevated support;

a second elongated spring member having one end coupled to said carrier and having an opposite end supported by said second elevated support;

a release mechanism formed to releasably couple said carrier relative to said elevated supports;

a tensioning mechanism operably coupled to one of said carrier and said first and said second spring members, said tensioning mechanism movable from an equilibrium position in which said first and said second spring members are in equilibrium, when said release mechanism couples said carrier relative to said elevated supports, to a stretched position in which said first and said second spring members are stretched to be under substantial tension;

wherein, upon release of said carrier by said release mechanism, said first and said second spring members project said carrier away from said release mechanism for oscillatory motion of said carrier until said first and said second spring members reach said equilibrium position.

2. The amusement ride apparatus of claim 1, further including a third elevated support and a third elongated spring member, said third spring member having one end coupled to said carrier and having an opposite end supported by said third elevated support, said third elevated support spaced apart from said first elevated support and said second elevated support by a distance sufficient to permit unobstructed passage of said carrier between all three said elevated supports.

3. The amusement ride apparatus of claim 1 wherein said first spring member and said second spring member are comprised of rubber.

4. The amusement ride apparatus of claim 1 wherein said tensioning mechanism is a winch, and said first elevated support and said second elevated support are vertical towers.

5. The amusement ride apparatus of claim 1 wherein said first spring member and said second spring member are formed to be free of slack during said oscillatory motion.

6. The amusement ride apparatus of claim 1, further including an elevating mechanism for accessing said carrier when said spring members are in said equilibrium position.

7. The amusement ride apparatus of claim 1, further including a base, said release mechanism couples said carrier to said base.

8. The amusement ride apparatus of claim 1, further including a first cable and a second cable, said first cable having one end connected to said opposite end of said first spring member, and having an opposite end coupled to said tensioning mechanism, said second cable having one end connected to said opposite end of said second spring member, and having an opposite end coupled to said tensioning mechanism.

9. The amusement ride apparatus of claim 8, further including a first cable support member and a second cable support member, said first cable support member supports said first cable, said second cable support member supports said second cable.

10. The amusement ride apparatus of claim 9 wherein said first cable support member is a pulley and said second cable support member is a pulley.

* * * * *

UNITED STATES PATENT AND TRADEMARK OFFICE

CERTIFICATE OF CORRECTION

PATENT NO. : 5,421,783

DATED : June 6, 1995

INVENTOR(S) : Peter T. Kockelman and John W. Kockelman

It is certified that error appears in the above-indentified patent and that said Letters Patent is hereby corrected as shown below:

Column 2, line 33, delete "pan" and insert therefor --part--.

Column 7, line 67, delete "am" and insert therefor --are--.

Column 7, line 68, delete "muted" and insert therefor --routed--.

Signed and Sealed this

Fourteenth Day of November, 1995

Bruce Lehman

*Attest:*

BRUCE LEHMAN

*Attesting Officer*

*Commissioner of Patents and Trademarks*